US005281943A

United States Patent [19]

Liao

[11] Patent Number: 5,281,943

[45] Date of Patent: Jan. 25, 1994

[54] ELECTRICAL CONNECTOR

[76] Inventor: Nan-Whair Liao, No. 18, Tzu Yu Road, Hsinchu, Taiwan

[21] Appl. No.: 8,353

[22] Filed: Jan. 22, 1993

[51] Int. Cl.[5] ..... H01H 85/02

[52] U.S. Cl. ..... 337/198; 439/622

[58] Field of Search ..... 337/197, 198; 439/621, 439/622

[56] References Cited

U.S. PATENT DOCUMENTS 4,684,914 8/1967 Wu ..... 337/198

4,904,976 2/1990 Liao ..... 337/198

*Primary Examiner*—Harold Broome

*Attorney, Agent, or Firm*—Morton J. Rosenberg; David I. Klein

[57] ABSTRACT

An electrical connector is provided which allows simple and efficient replacement of fuses contained within an electrical connector housing. The electrical connector includes a cover plate which is mounted at an upper section of the electrical connector housing. The cover plate is formed with a pair of separators and a projection extending from a lower surface of the cover plate. The two separators may be inserted between fuses and electrical prongs when the cover plate is prepared for opening. The projection pushes the fuses into contact with the electrical prongs in a firm manner for a good electrical connection when the cover plate is completely closed.

1 Claim, 10 Drawing Sheets

ELECTRICAL CONNECTOR

BACKGROUND OF THE INVENTION

1. Field of the Invention

This invention pertains to electrical connectors which allow simple and efficient replacement of fuses contained therein without danger to the user. In particular, this invention relates to electrical connectors where the fuses are displaced out of contact with the electrical prongs of the electrical connectors when the electrical connector housing is opened.

2. Prior Art

Electrical connectors containing fuses are known in the prior art. In order to change a broken fuse, prior art electrical connectors have an opening and a door on the face of the housing such as that shown in U.S. Pat. No. 4,684,914. In that prior art Patent, a flat plate and a plug are shown in FIG. 9. The plate is assembled with the face where the electrical prongs extend. Such is dangerous when the plate is displaced to assemble the electrical connector or plug. To open the plate of such a prior art system is difficult, in that a separate tool such as a screwdriver is needed to force the plate out. Another known plug is shown in U.S. Pat. No. 4,904,976, which includes a door combined with the plug. The door can be raised to a predetermined angle and closed. However, the door may be broken after some operations of opening and closing. Additionally, a further drawback is that the fuses in the plug may be damaged when the door is closed due to a direct heavy pressure thereon.

SUMMARY OF THE INVENTION

It is an object of the present invention to mitigate and/or obviate the above-mentioned drawbacks of prior art systems in the manner set forth in the description of the preferred embodiment, as herein described. A primary object of the present invention is to provide a connectable plug or electrical connector with fuses which has a cover plate which may be easily assembled.

Another object of the present invention is to provide a plug having a cover plate which includes a pair of separators and a projection where the separators may be inserted between fuses and electrical prongs when the cover plate is opened. The projection forces the fuses to touch the electrical prongs firmly for a good electrical connection when the cover plate is closed.

Further objects and advantages of the present invention will become apparent in the following description, and the features and novelty are characterized in the claims annexed to and forming a part of this invention.

DESCRIPTION OF THE PREFERRED EMBODIMENTS

Figure 1:
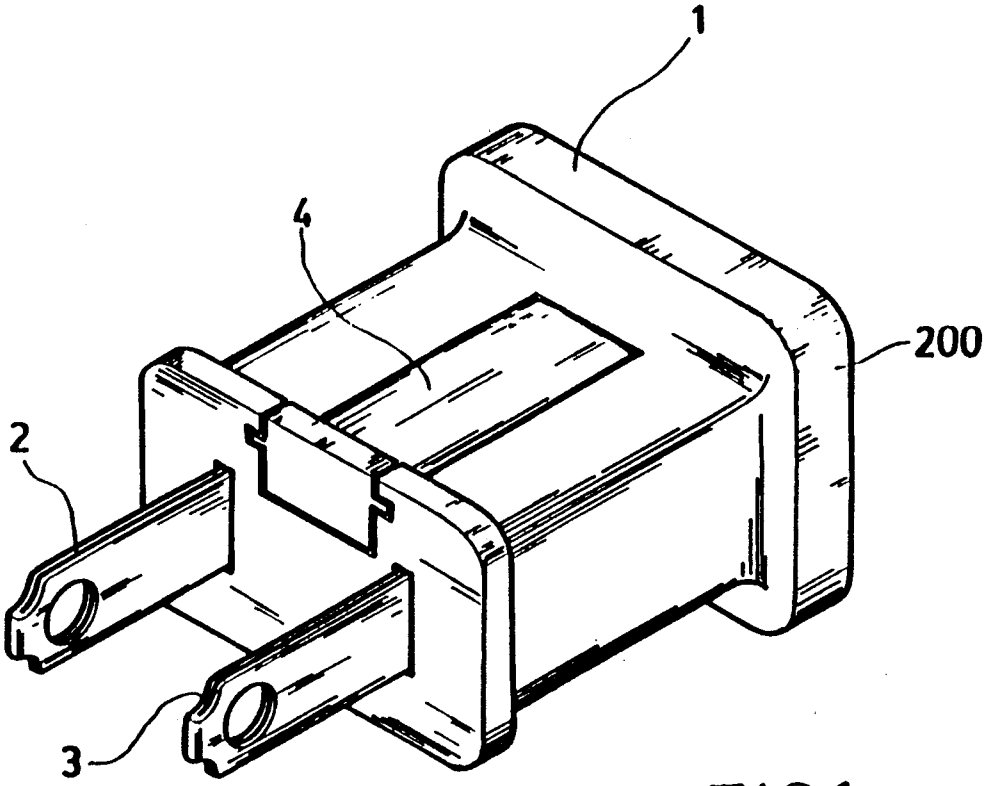
FIG. 1 is a perspective view of an assembled electrical connector or plug in accordance with the present invention.
Figure 2:
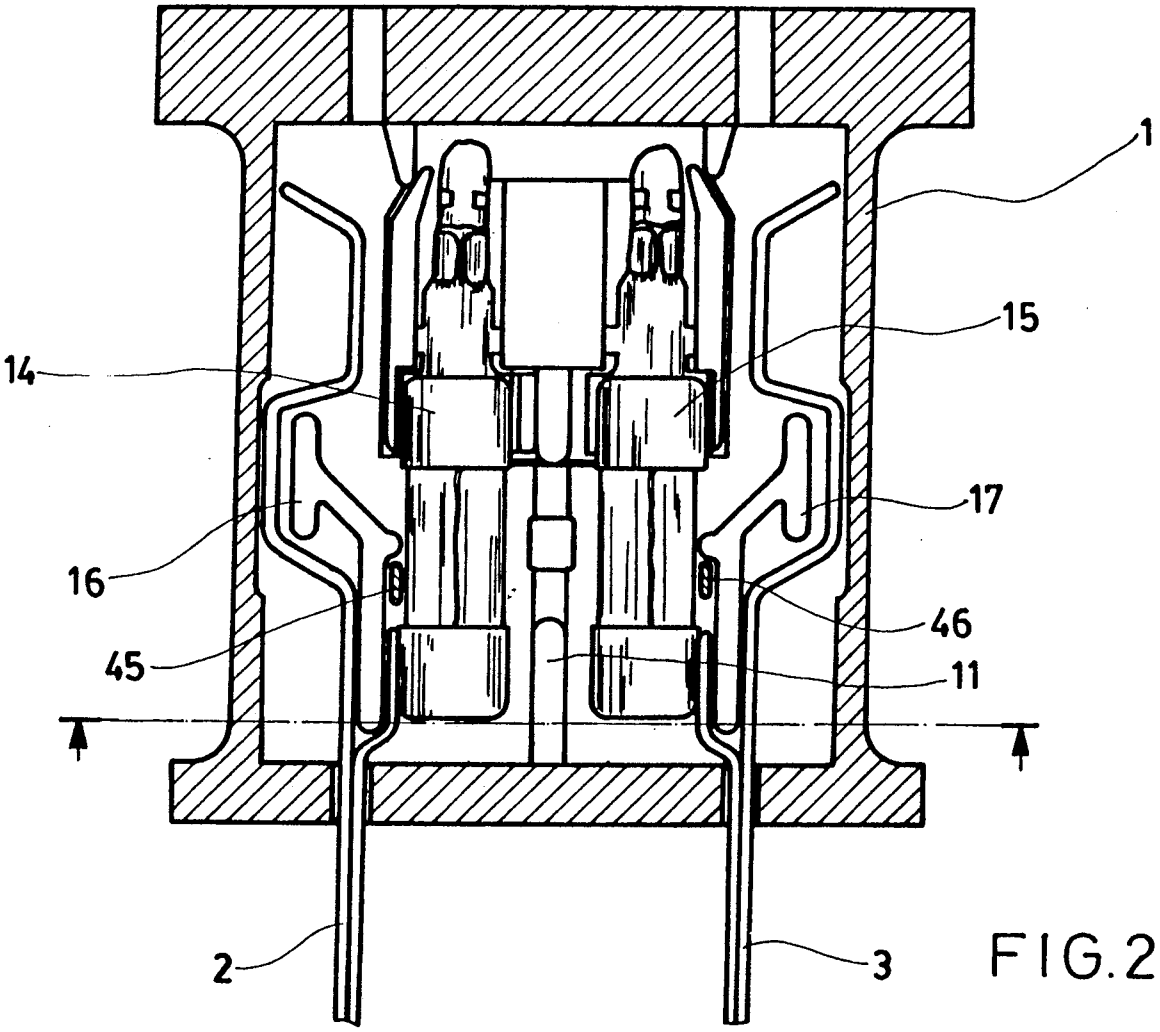
FIG. 2 is a horizontal cross-sectional view of the plug shown in FIG. 1.
Figure 3:
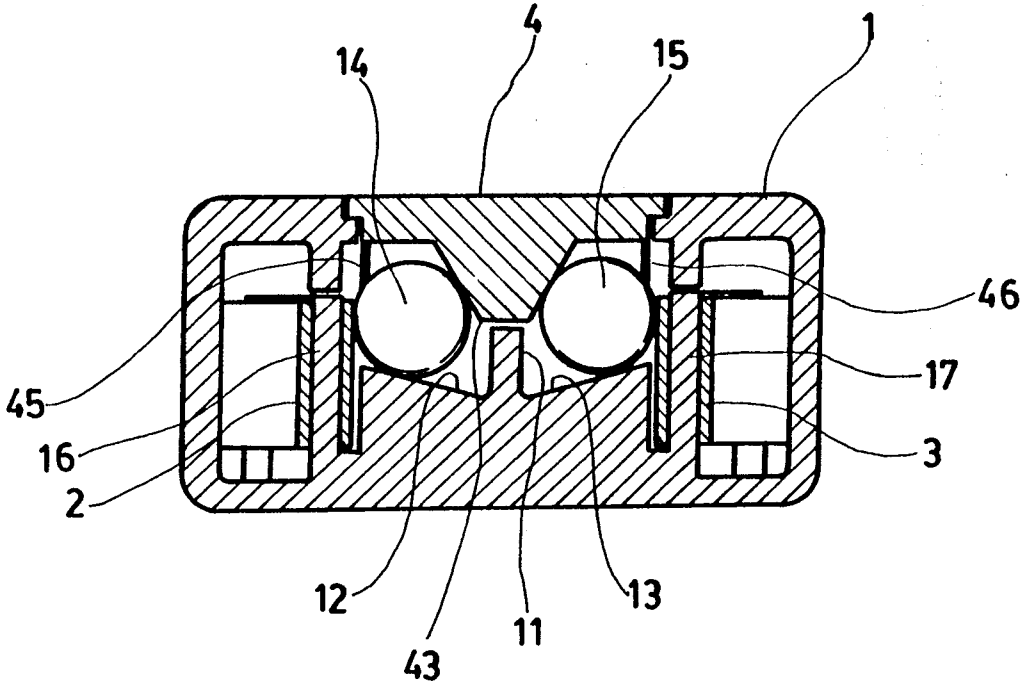
FIG. 3 is a vertical cross-sectional view of the plug shown in FIG. 1.
Figure 4:
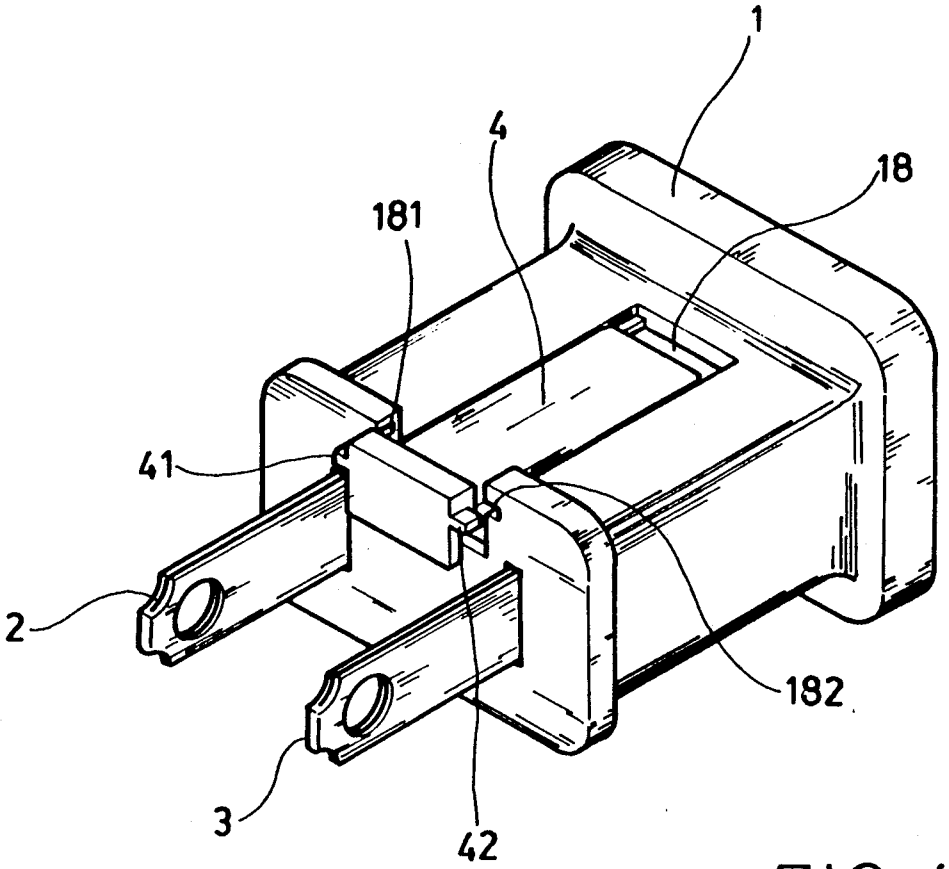
FIG. 4 is a perspective view of a plug being semi-closed in accordance with the present invention concept.
Figure 5:
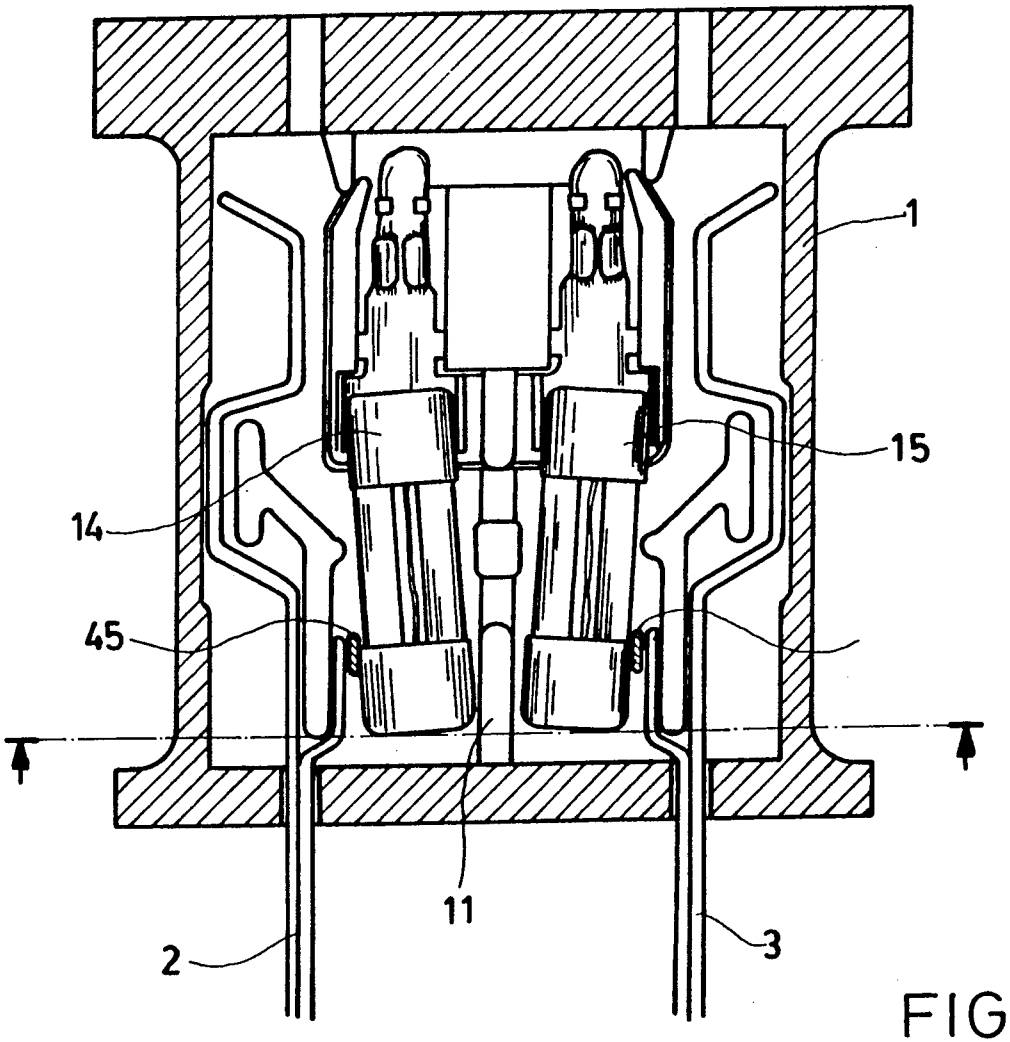
FIG. 5 is a horizontal cross-sectional view of the plug shown in FIG. 4.
Figure 6:
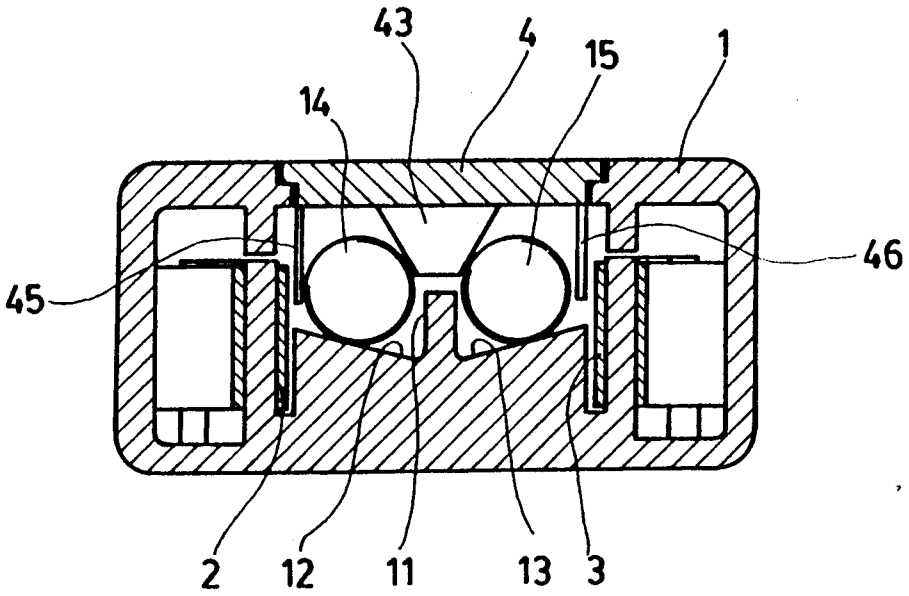
FIG. 6 is a vertical cross-sectional view of the plug shown in FIG. 4.
Figure 7:
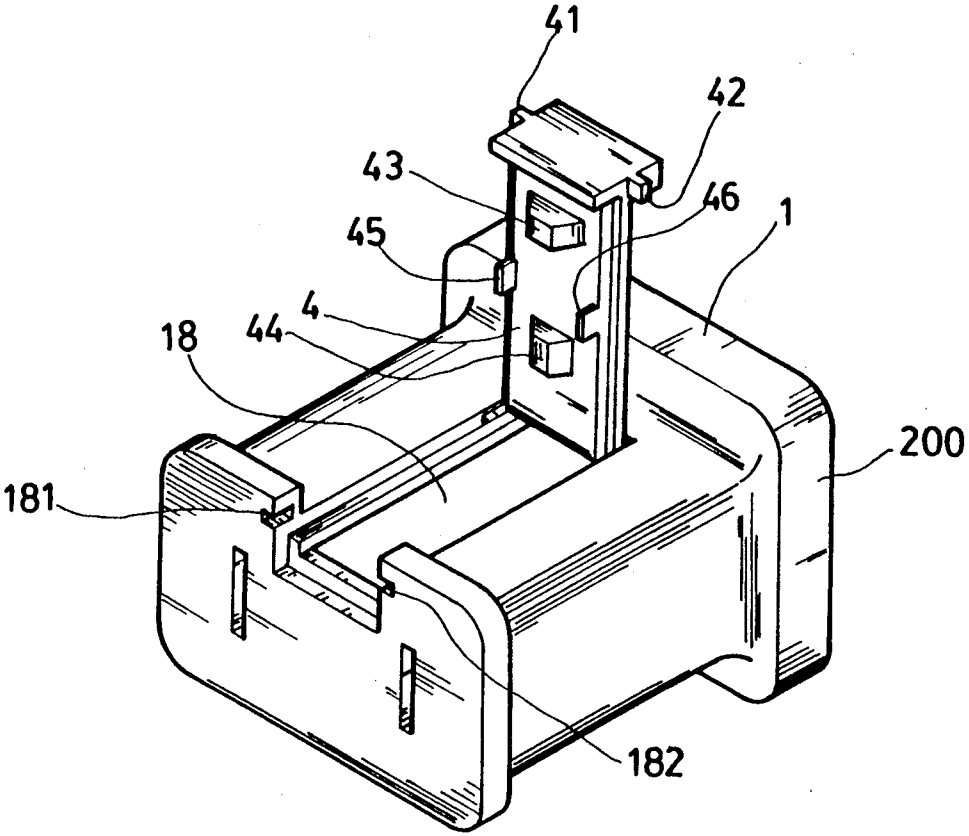
FIG. 7 is a perspective view of a plug being opened in accordance with the present invention concept.
Figure 8:
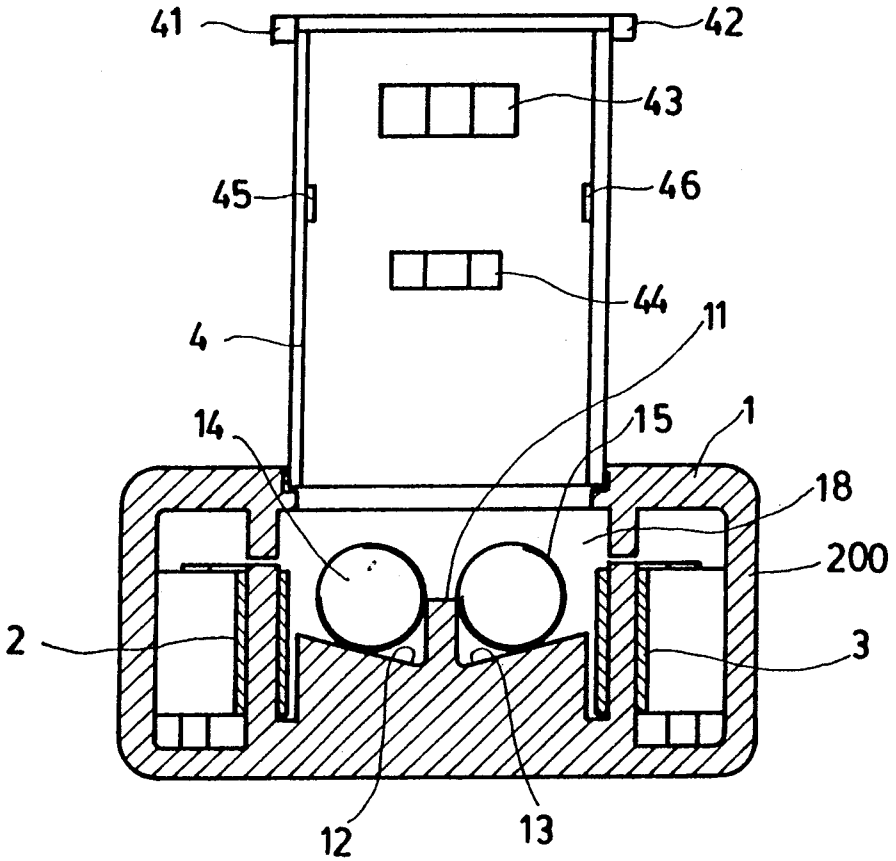
FIG. 8 is a vertical cross-sectional view of the plug shown in FIG. 7.
Figure 9:
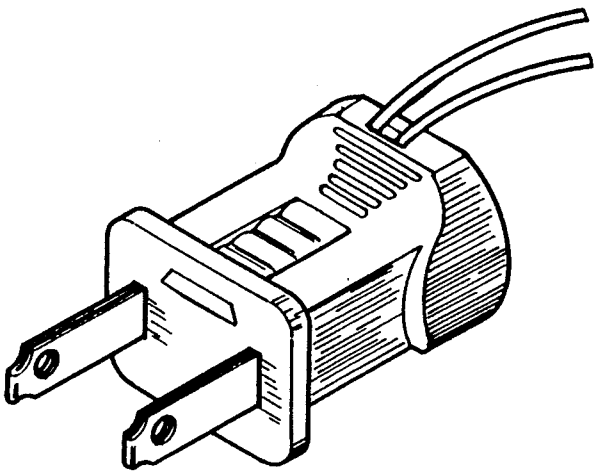
FIG. 9 (prior art)
FIG. 9 is a perspective view of a prior art electrical connector.
Figure 10:
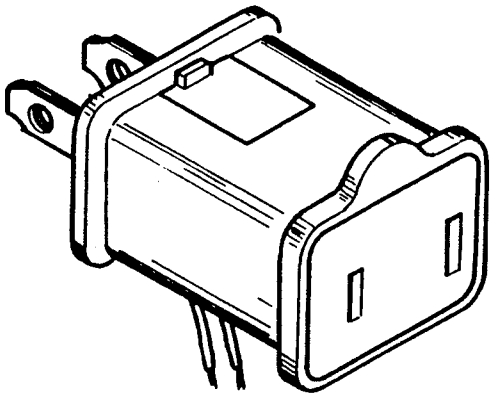
FIG.10 (prior art)
FIG. 10 is a perspective view of another prior art electrical connector.

Referring now to FIGS. 1–8, there is shown plug or electrical connector 1 which includes a cover plate 4, a pair of conducting inserts or electrical prongs 2 and 3, and an interior chamber 18 having an opening formed in an upper section of electrical housing 200, as is shown in FIGS. 7 and 8. A partition 11 is provided in the electrical connector housing 200 at a lower section thereof to separate interior chamber 18 into a pair of fuse insert chambers 12 and 13 which can receive fuses 14 and 15 independently on respective inclined lower walls, as shown in FIGS. 3, 6 and 8. Two spacer boards 16 and 17 are mounted in the connector housing 200 on opposing sides of the two fuse insert chambers 12 and 13 for engaging with the electrical prongs 2 and 3. Two slots 181 and 182 are formed at the top end of the housing 200 for guiding the cover plate 4 to be inserted into and engaged with the electrical connector 1 for closing the interior housing chamber as shown in FIGS. 1 and 4. The cover plate 4 is provided with a pair of tabs 41 and 42 on opposing transverse sides thereof. Tabs 41, 42 are engaged with the two slots 181 and 182 of the electrical connector 1. A pair of separators 45 and 46 are formed on opposing sides of the cover plate 4 and an inclined centrally located projection 43 is formed at the lower surface of the cover plate 4.

To open the cover plate 4 for removing or inserting a fuse 14 or 15, the cover plate 4 is pulled as shown in the progression from FIG. 1–FIG. 4. The cover plate 4 is raised upwardly as shown in FIGS. 4–7. It is to be understood that the insert and removal operation of fuses 14 and 15 is accomplished easily and without danger. During pulling the cover plate 4 outwardly, the separators 45 and 46 are inserted between the fuses 14, 15 and the electrical prongs 2, 3. The movement of the projection 43 of the cover plate 4 releases the fuses 14 and 15 and they move down to the bottom of the fuse insert chambers 12 and 13 along the inclined walls shown. Thus, the fuses 14, 15 do not contact the prongs 2, 3 and electrical connection is cut-off. The fuses 14, 15 may be replaced as shown in FIGS. 4–6.

After the changing operation, the cover plate 4 may be closed as shown in FIGS. 4–7 in reverse order. The cover plate 4 is pushed inwardly as shown in FIG. 4 to FIG. 1 to complete the assembly. In this operation, the separators 45, 46 are displaced from a position between the fuses 14, 15 and the electrical prongs 2, 3 and the projection 43 pushes the two fuses 14, 15 outwardly to contact the electrical prongs 2, 3 for a secure electrical connection. During the closing, the pressure force is directed horizontally to the fuses 14, 15. Thus, there is provided a simple, efficient, and time saving operation for replacement without danger to the user.

As various possible embodiments may be made of the above invention without departing from the scope of the invention, it is to be understood that all matter herein described or shown in the accompanying drawings is to be interpreted as illustrative and not in a limiting sense. Thus, it will be appreciated that the drawings are exemplary of a preferred embodiment of the invention.

What is claimed is:

1. An electrical connector having a pair of electrical prongs extending therefrom, comprising:

(a) a connector housing defining an interior housing chamber, said electrical prongs mounted internal said interior housing chamber and extending from said connector housing in side by side relation, said connector housing defining a lower section having an upstanding partition member for dividing said interior housing chamber into a pair of fuse insert chambers having respective inclined lower walls, said connector housing defining an upper section having a cover plate opening formed therein;

(b) a pair of fuses respectively insertable into said fuse insert chambers for sliding engagement with said respective inclined lower walls;

(c) a pair of spacer boards located between said respective fuses and said electrical prongs within said connector housing chamber;

(d) a cover plate member for covering said cover plate opening of said upper section of said connector housing, said cover plate member having a pair of opposing tab members for sliding engagement with a pair of housing grooves formed in said upper section of said connector housing, said cover plate member having an inclined centrally located projection member extending from a lower surface of said cover plate member for interfacing with said respective fuses and sliding said fuses along said inclined lower walls into engagement with said respective electrical prongs when said cover plate member closes said cover plate opening; and, (e) a pair of separator members extending from a lower surface of said cover plate member on opposing sides thereof for insertion between a portion of each of said fuses and a respective spacer board when said cover plate member closes said cover plate opening.

* * * * *